United States Patent [19]

Blake et al.

[11] Patent Number: 4,545,873

[45] Date of Patent: Oct. 8, 1985

[54] VESSEL FOR AN UNSTABLE SOLUTION OF A METAL SALT OR COMPLEX AND METHOD FOR SEALING SUCH VESSEL

[75] Inventors: Colin C. Blake, Rochford; Paul A. Bacon, Hornchurch, both of England

[73] Assignee: Ciba-Geigy AG, Basel, Switzerland

[21] Appl. No.: 456,895

[22] Filed: Jan. 10, 1983

[30] Foreign Application Priority Data

Jan. 19, 1982 [GB] United Kingdom ..... 8201366

[51] Int. Cl.[4] ..... C25C 1/20; C25D 17/00; C25D 21/10

[52] U.S. Cl. ..... 204/109; 204/212; 204/231; 204/242; 204/273; 204/279

[58] Field of Search ..... 204/231, 196, 273, 197, 204/279, 212, 242, 109

[56] References Cited

U.S. PATENT DOCUMENTS

| | | | |
|---|---|---|---|
| 3,169,504 | 2/1965 | Gruber | 115/0.5 |
| 3,240,685 | 3/1966 | Maissel | 204/15 |
| 3,429,799 | 2/1969 | McWhorter | 204/279 |
| 3,486,999 | 12/1969 | Craft | 204/197 |
| 3,573,175 | 3/1971 | Bedi | 204/15 |
| 3,910,833 | 10/1975 | Knighton | 204/273 |
| 3,985,634 | 10/1976 | Larson et al. | 204/212 |
| 4,110,181 | 8/1978 | Sluse et al. | 204/147 |
| 4,113,600 | 9/1978 | Cook | 204/197 |

FOREIGN PATENT DOCUMENTS 1224047 3/1971 United Kingdom .

*Primary Examiner*—Donald R. Valentine
*Attorney, Agent, or Firm*—Harry Falber

[57] ABSTRACT

The rotating shaft is sealingly mounted in a wall of the vessel by a liquid-tight lip seal. In order to avoid undesired depositions on the seal the latter is made of electroconductive material and connected to the anode of a source of electricity the cathode of which is connected to a counter-electrode within the vessel.

7 Claims, 1 Drawing Figure

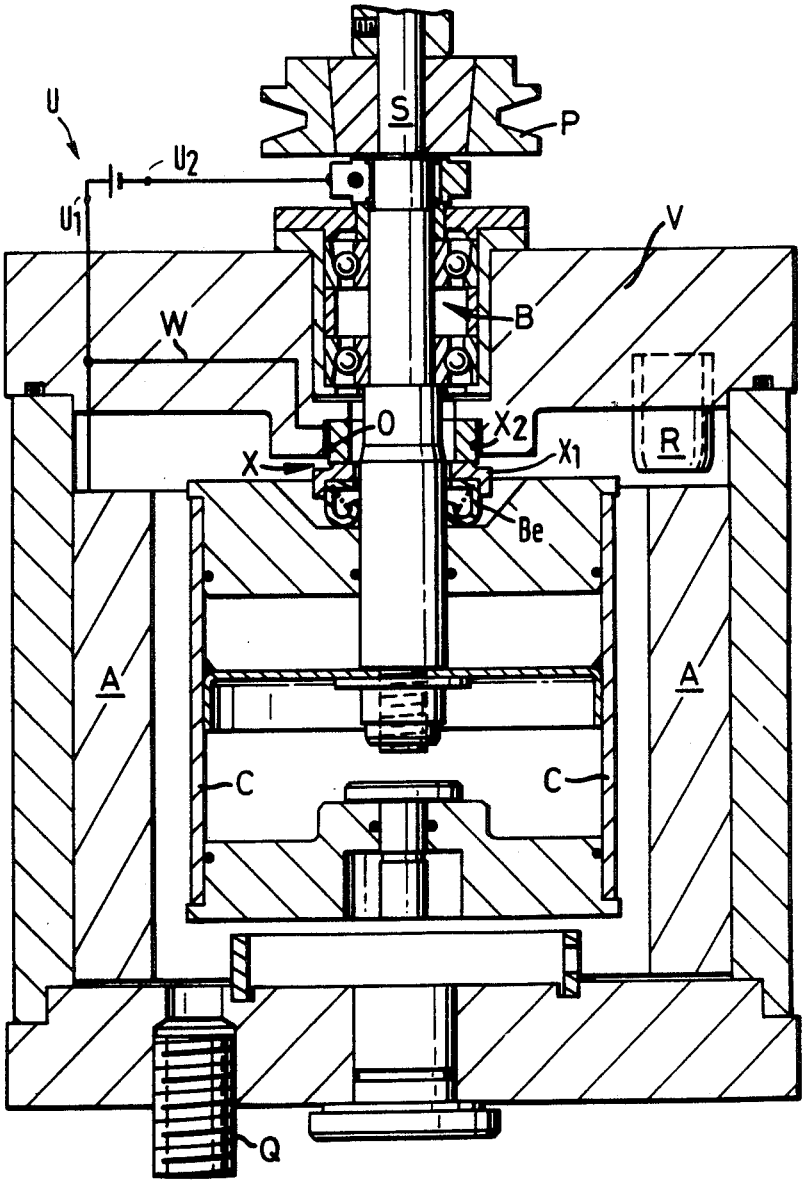
U
U2
U1
S
P
V
W
B
O
X2
X
X1
R
Be
A
A
C
C
Q

VESSEL FOR AN UNSTABLE SOLUTION OF A METAL SALT OR COMPLEX AND METHOD FOR SEALING SUCH VESSEL

This invention relates to the effective sealing of pressurised vessels having therein a reciprocating or rotating shaft and which contain an unstable solution of a metal salt or complex.

Many solutions of metal salts or complexes are unstable in that under certain conditions the salt or complex breaks down throwing the metal out of solution. In particular silver and copper salt or complex solutions are particularly unstable.

Pressurised vessels having therein a reciprocating or rotating shaft which may act to mix or agitate the contents of the vessel for example require a sealing means around the shaft to prevent the contents of the vessel from escaping at the point where the shaft enters the vessel. Various methods of effecting such sealing have been developed and these methods include the use of stuffing boxes and in particular lip seals and mechanical face seals. However all such sealing techniques require the intimate contact of two surfaces, one surface rotating or reciprocating relative to the other. In the case of a lip seal these surfaces are the lip seal and the shaft itself. In the case of a mechanical face seal the surfaces are the faces of the two components of the seal one static and the other rotating with the shaft.

It is a fundamental requirement of such sealing systems that a thin fluid film of the sealed liquid is present between the two surfaces, this film effectively providing the sealing medium.

It has been observed when such sealing systems are used for vessels containing unstable solutions of metal salts or complexes that decomposition of the liquid film between the sealing faces occurs resulting in deposition of the metal on the seal faces which leads to severe leakage of the solution from the vessel.

This phenomenon of seal failure is particularly severe when aqueous solutions of silver salts or silver complex salts are used.

In U.S. Pat. No. 3,910,833 an electrolytic silver recovery vessel is described which comprises a complicated and expensive fluid sealing practice. In U.S. Pat. No. 3,985,634 an electrolytic silver recovery vessel is described which comprises a seal consisting of thin circular discs composed of modified tetrafluor-ethylene. These discs act as an effective seal but trouble is nevertheless experienced when silver deposits on the seal.

In British Patent Specification No. 1,224,047 an anodic passivation process is described in which nickel is alledged to be prevented from being deposited on unwanted areas of the coating bath by provision of an alkaline solution and a porous partition. This might work for a nickel plating bath but could not be employed in a silver recovery cell in which an acidic solution is electrolysed.

The present invention provides a technique of suppressing leakage and allowing effective sealing of the vessel to be achieved.

Therefore according to the present invention there is provided a method of sealing a pressurised vessel which comprises a reciprocating or rotating shaft and which contains an unstable solution of a metal salt or complex which comprises using as a seal for the shaft an electroconductive material, providing in the body of the vessel a counter-electrode electrically connected to the shaft and applying a voltage across the seal and the counter-electrode so that the seal is made the anode electrode of the thus formed cell.

In one embodiment of the invention the seal is a mechanical face seal and the non-rotating part of the seal is made of an electro-conductive material.

In another embodiment of the invention the seal is a lip seal which is made of an electro-conductive material.

The method of the present invention is of particular use when the pressurised vessel is an electrolytic recovery vessel which contains a rotating electrode. Also it is of use when the pressurised vessel is the pressurised chamber of a pump.

The method of the present invention is of especial use when the unstable solution of a metal salt or complex is a solution of a silver salt or complex because such solutions tend to be extremely unstable.

In order to illustrate the method of the present invention reference is made to the accompanying drawing.

The FIGURE is a cross-sectional side view of an electrolytic metal recovery vessel having a rotating cathode. The metal ion aqueous solution is circulated in the vessel under pressure.

The electrolytic recovery apparatus comprises a cylindrical vessel V composed of polyvinyl chloride. Inside the vessel V is a rotating cathode C composed of stainless steel. Cathode C is mounted on a drive shaft S which is mounted in a bearing B in the housing vessel V. Shaft S is attached to a pulley wheel P which is connected to external drive means (not shown). The electrical connection to cathode C is via the shaft S. The drive means causes the cathode C to rotate in the vessel V. Shaft S is sealed in the vessel V by a mechanical sealing system X which consists of a rotating face seal $X_1$ fixed on the shaft S by rubber bellows Be. The face seal $X_1$ is in close contact with a counter-face seal $X_2$ fixed to the top housing of the vessel V by an 'O' ring 0.

Present attached concentrically to the inside wall of the vessel V is a graphite anode A.

A solution inlet port Q leads from a solution vessel (not shown) via a pump to the interior of the vessel V and an outlet pipe R leads out of the vessel V.

An electrical connection W is shown connecting the counter-face seal $X_2$ with the anode A.

The material of which the seals $X_1$ and $X_2$ are composed will be described in detail later.

Neglecting the electrical connection W, in normal operation an aqueous solution of a metal ion is pumped into the interior of the vessel V via the inlet Q and the cathode C and the anode A are connected via electrical terminals $U_1$ and $U_2$ to a source of electricity U to form an electric cell. Cathode C is caused to rotate and the metal in the aqueous solution is deposited on the cathode. The aqueous solution is continually pumped slowly into the vessel V via inlet Q and it leaves via the outlet R so the solution in the vessel V is always under pressure.

It is necessary to form a liquid-tight seal around the shaft S. If a liquid-tight seal is not formed liquid will creep up the shaft and come out at the top of the vessel. This causes the bearing B which will then be in contact with the solution to deteriorate and also causes a mess as the solution is forced out of the top of the vessel around the shaft in an uncontrolled manner. Thus it is necessary that seals $X_1$ and $X_2$ form what is known as a liquid seal. Thus as seal $X_1$ which is fixed on the rotating shaft rotates in close contact with seal $X_2$ a thin film of liquid forms a liquid seal between the two which prevents the seals from coming into physical contact and acts as a lubricant between the two seals.

However if an unstable solution of a metal salt or complex is present in the vessel it has been found that this solution will tend to break down in the liquid seal position and the metal will be deposited on the faces of the seals $X_1$ and $X_2$.

This tends to force the face of the seals apart and allow more solution into the seal with the consequence that more metal is deposited in the faces of the seals until eventually they are forced apart to such an extend that there is no longer a liquid seal and liquid will flow up the shaft.

In one experiment the rotating face seal $X_1$ was ceramic and the static face seal $X_2$ was graphite.

As a preliminary test the cell was not connected to a source of electricity but water was passed through the vessel V at 15 p.s.i. and the cathode C was caused to rotate at 1000 r.p.m. No leakage from the vessel was observed after 48 hours continuous running.

In a second test again the cell was not connected to a source of electricity but a sodium chloride solution (100 g per liter) was continuously pumped through the vessel at 15 p.s.i. the cathode again being rotated at 1000 r.p.m. Again no leakage from the vessel was observed after 48 hours continuous running. In this case sodium chloride is a stable salt solution.

In a third test a made-up solution which approximates to a used photographic fixing solution was employed. This solution comprised:

Ammonium thiosulphite: 0.5 mole/liter
sodium sulphite: 0.1 mole/liter
acetic acid: 0.2 mole/liter
silver bromide: 0.03 mole/liter In fact the silver bromide will form an unstable water-soluble complex with the thiosulphite so that an unstable aqueous solution of a silver salt will be formed.

Again the cell was not connected but the fixer solution was pumped through the vessel at 15 p.s.i., the cathode being rotated at 1000 r.p.m.

After 3 hours liquid was observed leaking out of the vessel where the shaft S enters the vessel. The operation was stopped and the seals $X_1$ and $X_2$ were examined. It was found that metallic silver had deposited on both of the seals thus forcing them apart and breaking the liquid seal between them.

In a fourth experiment the same fixer solution was pumped through the same vessel under the same conditions but in this case the cell was connected to a source of electricity but lead W was not attached to the seal $X_2$. The vessel then acted as an electrolytic cell with a current density of 0.2 A $cm^{-2}$. However again after two hours liquid was observed leaking from the vessel around the shaft S. The experiment was then stopped and the vessel opened. On inspection silver metal was found deposited on the cathode C as a powder. Silver metal was also found deposited on the faces of both seals $X_1$ and $X_2$.

In a fifth experiment the same fixer solution was pumped through the same vessel under the same conditions, the cell being connected to a source of electricity but in this case lead W was connected to the anode A of the electrically conductive seal $X_2$. But in this case even after 48 hours continuous running no leakage was observed from the vessel. The experiment was then stopped and the vessel opened up. Again silver was found deposited on the cathode as a powder. However no silver metal nor any other deposit was found on the face of either seals $X_1$ or $X_2$.

In this case the potential between the seal $X_2$ and the shaft was 1.5 volts.

Another suitable electro-conductive material from which to form the static seal $X_2$ is stainless steel.

The rotating seal $X_1$ can also be composed of graphite or stainless steel. Other suitable materials of construction include tungsten carbide and polytetrafluorethylene. The preferred combination is graphite and graphite.

In the experiment as just described the vessel is an electrolytic cell and the current generated by the potential difference between the seal $X_2$ and the cathode will cause some of the deposition of the silver metal on the cathode. However when the method of the present invention is employed to protect seals in other pressurised vessels in which a shaft rotates or reciprocates the dimension of the counter-electrode and if necessary by shielding the electro-conductive seal electrically the current carried by the thus formed cell can be kept to a minium. Thus the quantity of metal plated on the counter electrode together with any side effects on the solution on the vessel can be minimised.

What is claimed is:

1. A method of sealing a pressurised vessel which has a reciprocating or rotating shaft and which contains an unstable solution of a metal salt or complex, said method comprising forming a seal for the shaft composed at least in part of an electro-conductive material, inserting in the body of the vessel a counter-electrode electrically connected to the shaft and applying a voltage across the seal and the counter-electrode so that the seal is made the anode electrode of the thus formed cell.

2. A method according to claim 1 wherein the unstable solution is a solution of a silver salt or complex.

3. A vessel for an unstable solution of a metal salt or complex comprising a reciprocating or rotating shaft extending through a wall of the vessel and mounted in a liquid-tight seal, whereby at least part of said seal is of electro-conductive material, said vessel further comprising a counter-electrode in its body electrically connected to the shaft and electric terminals electrically connected to said seal and said counter-electrode for applying a voltage there across.

4. A vessel according to claim 3 wherein the seal is a mechanical face seal having a rotating and a non-rotating part whereby at least the latter is of electro-conductive material.

5. A vessel according to claim 4 wherein the electro-conductive material is graphite.

6. A vessel according to claim 3 wherein the seal is a lip seal which is made of electro-conductive material.

7. A vessel according to claim 6 wherein the electro-conductive material is graphite or stainless steel.

* * * * *